US011203803B2

(12) United States Patent
Minamino et al.

(10) Patent No.: US 11,203,803 B2
(45) Date of Patent: Dec. 21, 2021

(54) STEEL WITH HIGH HARDNESS AND EXCELLENT TOUGHNESS

(71) Applicants: OSAKA UNIVERSITY, Suita (JP); KOMATSU LTD., Tokyo (JP)

(72) Inventors: Yoritoshi Minamino, Suita (JP); Takemori Takayama, Hirakata (JP); Koji Yamamoto, Tokyo (JP); Yusuke Hiratsuka, Himeji (JP)

(73) Assignees: OSAKA UNIVERSITY, Suita (JP); KOMATSU LTD., Tokyo (JP)

( * ) Notice: Subject to any disclaimer, the term of this patent is extended or adjusted under 35 U.S.C. 154(b) by 219 days.

(21) Appl. No.: 15/757,968

(22) PCT Filed: Sep. 16, 2016

(86) PCT No.: PCT/JP2016/077493
§ 371 (c)(1),
(2) Date: Mar. 6, 2018

(87) PCT Pub. No.: WO2017/047767
PCT Pub. Date: Mar. 23, 2017

(65) Prior Publication Data

US 2020/0165710 A1 May 28, 2020

(30) Foreign Application Priority Data

Sep. 18, 2015 (JP) ..... JP2015-185149

(51) Int. Cl.
*C22C 38/18* (2006.01)
*C22C 38/06* (2006.01)
(Continued)

(52) U.S. Cl.
CPC ..... *C22C 38/18* (2013.01); *C22C 38/06* (2013.01); *C22C 38/34* (2013.01); *C22C 38/38* (2013.01);
(Continued)

(58) Field of Classification Search
CPC ..... C22C 38/58; C22C 38/06; C22C 38/34; C22C 38/44; C22C 38/46; C22C 38/02;
(Continued)

(56) References Cited

U.S. PATENT DOCUMENTS 5,108,518 A 4/1992 Fukui et al.
2004/0047757 A1 3/2004 Takayama
(Continued)

FOREIGN PATENT DOCUMENTS

CN 101565801 A 10/2009
CN 103122433 A 5/2013
(Continued)

OTHER PUBLICATIONS

Hui, Weijun, "Ultra-Fine Grained Steels," 2009, Weng, Yuqing (ed), Springer, p. 321-324 (Year: 2009).*
(Continued)

*Primary Examiner* — Anthony J Zimmer
*Assistant Examiner* — Dean Mazzola
(74) *Attorney, Agent, or Firm* — Faegre Drinker Biddle & Reath LLP

(57) ABSTRACT

A steel with high hardness and excellent toughness contains, in mass %, 0.55-1.10% C, 0.10-2.00% Si, 0.10-2.00% Mn, 0.030% or less P, 0.030% or less S, 1.10-2.50% Cr, and 0.010-0.10% Al, with the balance consisting of Fe and unavoidable impurities. The structure of the steel after quenching is a dual phase structure of martensitic structure and spheroidized carbide. Spheroidized cementite particles with an aspect ratio of 1.5 or less constitute at least 90% of all cementite particles. The proportion of the number of
(Continued)

spheroidized cementite particles on the prior austenite grain boundaries to a total number of cementite particles is 20% or less.

11 Claims, 3 Drawing Sheets

(51) Int. Cl.

| | |
|---|---|
| ***C22C 38/34*** | (2006.01) |
| ***C22C 38/44*** | (2006.01) |
| ***C22C 38/46*** | (2006.01) |
| ***C22C 38/58*** | (2006.01) |
| ***C22C 38/38*** | (2006.01) |
| *C21D 6/00* | (2006.01) |
| *C21D 1/613* | (2006.01) |

(52) U.S. Cl.
CPC ..... *C22C 38/44* (2013.01); *C22C 38/46* (2013.01); *C22C 38/58* (2013.01); *C21D 1/613* (2013.01); *C21D 6/004* (2013.01); *C21D 6/005* (2013.01); *C21D 6/008* (2013.01); *C21D 2211/001* (2013.01); *C21D 2211/003* (2013.01); *C21D 2211/008* (2013.01)

(58) Field of Classification Search
CPC ..... C22C 38/04; C22C 38/38; C22C 38/12; C22C 38/18; C22C 38/22; C22C 38/24; C22C 38/40; C21D 6/004; C21D 6/005; C21D 6/008; C21D 2211/001; C21D 2211/003; C21D 2211/008; C21D 6/02; C21D 1/613
See application file for complete search history.

(56) References Cited

U.S. PATENT DOCUMENTS

| | | | | |
|---|---|---|---|---|
| 2012/0018050 | A1 | 1/2012 | Kubota et al. | |
| 2016/0333438 | A1 * | 11/2016 | Sakamoto et al. ..... | C21D 9/40 |

FOREIGN PATENT DOCUMENTS

| | | | | |
|---|---|---|---|---|
| CN | 103764862 | A | 4/2014 | |
| JP | H05-078781 | A | 3/1993 | |
| JP | H05-37202 | B2 | 6/1993 | |
| JP | H10-102185 | A | 4/1998 | |
| JP | 2000-144311 | A | 5/2000 | |
| JP | 2003-35656 | A | 2/2003 | |
| JP | 2005-139534 | A | 6/2005 | |
| JP | 2007-231345 | A | 9/2007 | |
| JP | 2010-229475 | A | 10/2010 | |
| WO | 2011/114836 | A1 | 9/2011 | |
| WO | 2015105187 | A1 * | 1/2014 | ..... C22C 38/00 |

OTHER PUBLICATIONS

Yamamoto et al., "Effects of refinement of austenite grain and cementite particles on the impact value of hardened steels," Current advances in materials and processes, Sep. 1, 2012, vol. 25, No. 2, p. 314.

"High carbon chromium bearing steels," JIS Handbook 1 Tekko I (Yoko?Kensa?Shiken), Jan. 19, 2007, p. 1317, ISBN 978-4-542-17481-8.

Oct. 25, 2016 International Search Report issued in International Patent Application No. PCT/JP2016/077493.

* cited by examiner

STEEL WITH HIGH HARDNESS AND EXCELLENT TOUGHNESS

TECHNICAL FIELD

The present invention relates to steels with high hardness and excellent toughness, among steels for mechanical structure use which are used for components of automobiles or various industrial machines.

BACKGROUND ART

Steels used for components of automobiles or various industrial machines, especially steels used for components requiring wear resistance and excellent fatigue characteristics, are generally quenched to increase the hardness before being used. A steel material primarily having a martensitic structure as a result of quenching has its hardness determined by its C content; an increased C content leads to an increased hardness of the steel material. Increasing the hardness of a steel material, however, degrades its toughness, so the steel material may break on impact. The steel material thus requires a good balance between hardness and toughness.

As conventional techniques for addressing such requirements, a steel having both excellent wear resistance and toughness has been proposed (see, for example, Japanese Patent Application Laid-Open No. H10-102185 (Patent Literature 1)). The proposed steel includes Si, Nb, Cr, Mo, and V as its components and is subjected to particular rolling and other processing, so that it will form, during use, a composite precipitate of Cr, Mo, and V, with V being the nuclei.

Further, a high carbon steel excellent in shock and wear resistance has been proposed (see, for example, Japanese Patent Publication No. H05-37202 (Patent Literature 2)). The literature states as follows. In the case where a steel includes alloy constituents such as Mn, Ni, and Cr in its components, carbides of Mn, Ni, and Cr would precipitate at the prior austenite grain boundaries during the process of tempering after quenching, thereby causing intergranular fracture. To address this problem of intergranular fracture, when Mo is added to components of a high carbon steel containing 0.50-1.00% C, carbides of Mo will precipitate with dislocations in the prior austenite grains as nucleuses. This allows the precipitates to be finely distributed in the prior austenite grains, causing no intergranular fracture.

Further, a high strength and high toughness wear-resistant steel which is superior in strength, toughness, and wear resistance has been proposed (see, for example, Japanese Patent Application Laid-Open No. H05-078781 (Patent Literature 3)). According to the proposed technique, the contents of P and S are decreased for reduced grain boundary segregation, the content of Mn is decreased for reinforced grain boundary, and the content of Mo is increased and Nb is added for grain refining, so that toughness is improved. Further, Nb, Cr, and Mo are added in combination to make the steel considerably increased in temper softening resistance. This allows adopting a high tempering temperature, which also leads to improved toughness.

Furthermore, a steel with high strength and high toughness has been proposed (see, for example, Japanese Patent Application Laid-Open No. 2005-139534 (Patent Literature 4)). The proposed steel is a hypereutectoid steel, the core of the steel material having a dual phase structure of ferrite and spheroidized carbide, wherein the carbides are distributed appropriately, and ferrite is responsible for toughness. The surface alone is hardened by induction hardening or the like, to obtain a desired hardness.

CITATION LIST

Patent Literature

Patent Literature 1: Japanese Patent Application Laid-Open No. H10-102185

Patent Literature 2: Japanese Patent Publication No. H05-37202

Patent Literature 3: Japanese Patent Application Laid-Open No. H05-078781

Patent Literature 4: Japanese Patent Application Laid-Open No. 2005-139534

SUMMARY OF INVENTION

Technical Problem

Referring to the cited literatures above, in order to form a composite precipitate of Cr, Mo, and V in Patent Literature 1, the tempering needs to be conducted at a temperature of 200-550° C., in which case prescribed hardness may not be obtained. In Patent Literature 3, improved toughness is obtained by adding Mo to the alloy steel only if the tempering is conducted at a high temperature of 500° C. The effect is unclear if tempering is conducted at a low temperature for securing sufficient hardness. Further, in the case of using the hypereutectoid steel in Patent Literature 4, this conventional technique has failed to obtain satisfactory toughness under the condition that general quenching such as oil quenching is performed to make the steel have a martensitic structure to its core.

In view of the foregoing, an object of the present invention is to provide a steel material having both high hardness and high toughness under the condition that it is quenched and then tempered at a low temperature for keeping the hardness high.

Solution to Problem

Solutions of the present invention for achieving the above object include the following. The first solution is a steel with high hardness and excellent toughness, containing, in mass %, 0.55-1.10% C, 0.10-2.00% Si, 0.10-2.00% Mn, 0.030% or less P, 0.030% or less S, 1.10-2.50% Cr, and 0.010-0.10% Al, with the balance consisting of Fe and unavoidable impurities; a structure of the steel after quenching being a dual phase structure of martensitic structure and spheroidized carbide; spheroidized cementite particles with an aspect ratio of 1.5 or less constituting at least 90% of all cementite particles; regarding cementite on prior austenite grain boundaries, a proportion of the number of spheroidized cementite particles on the prior austenite grain boundaries to a total number of cementite particles being 20% or less.

The second solution is the steel with high hardness and excellent toughness according to the first solution, containing, in mass %, in addition to the chemical components in the first solution, one or two or more selected from among 0.10-1.50% Ni, 0.05-2.50% Mo, and 0.01-0.50% V, with the balance consisting of Fe and unavoidable impurities; the structure of the steel after quenching being the dual phase structure of the martensitic structure and the spheroidized carbide; the spheroidized cementite particles with the aspect ratio of 1.5 or less constituting at least 90% of all the cementite particles; regarding the cementite on the prior austenite grain boundaries, the proportion of the number of spheroidized cementite particles on the prior austenite grain boundaries to the total number of cementite particles being 20% or less.

The third solution is the steel with high hardness and excellent toughness according to the first or second solution, wherein at least 90% of the spheroidized cementite particles on the prior austenite grain boundaries have a particle size of 1 μm or less.

The fourth solution is the steel with high hardness and excellent toughness according to the first or second solution, wherein prior austenite grains have a grain size of 1-5 μm.

Effects of the Invention

The steel according to the present invention is a hypereutectoid steel which has, after quenching, a dual phase structure of martensitic structure and spheroidized carbide, wherein the proportion of the number of spheroidized cementite particles with an aspect ratio of 1.5 or less to the total number of cementite particles is at least 90%. Thus, there are only a small number of cementite particles having a plate-like shape or nearly columnar shape, which would likely become origins of cracking as stress would focus on the ends of such cementite particles during deformation. Rather, cementite particles of nearly spherical shape, which would not likely cause stress concentration, are uniformly distributed, thus achieving a structure having a low risk that cementite particles become origins of cracking. Further, the proportion of the number of spheroidized cementite particles on the prior austenite grain boundaries to the total number of cementite particles is as small as 20% or less, and preferably at least 90% of the spheroidized cementite particles on the prior austenite grain boundaries have a particle size of 1 μm or less, whereby intergranular fracture that would degrade toughness is suppressed. Accordingly, even though the steel of the present invention is a hypereutectoid steel, it has a less harmful effect that the cementite particles would become origins of cracking, and it is superior in hardness and toughness, with HRC hardness of 58 HRC or more and the Charpy impact value of 40 J/cm$^2$ or more. This steel material can be used to produce components for automobiles or various industrial machines which require high hardness and high toughness.

DESCRIPTION OF EMBODIMENT

Figure 1:
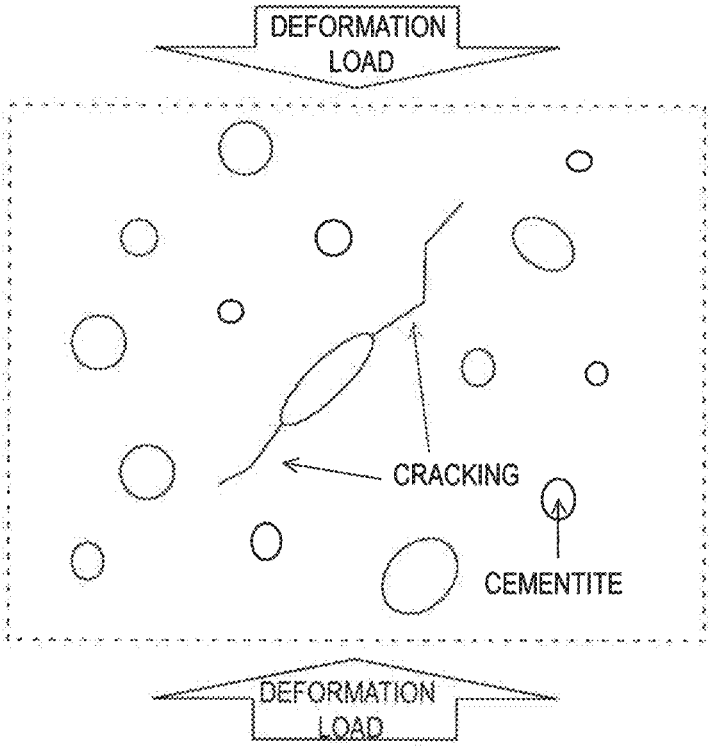
FIG. 1 is a schematic diagram showing cracking occurring from a cementite particle having a large aspect ratio, circles and ellipses in the figure showing cementite particles, the deformation load being not limited to compression.

Prior to describing an embodiment of the present invention, a description will be made about the reasons for limiting the chemical components of the steel, the proportion of the number of spheroidized cementite particles having an aspect ratio of 1.5 or less, and the proportion of the number of spheroidized cementite particles on the prior austenite grain boundaries, which are the constituent features of the invention recited in claim 1 of the present application, as well as the reasons for limiting the particle size of the spheroidized cementite particles on the prior austenite grain boundaries, and the grain size of the prior austenite grains. It should be noted that % used for chemical components is mass %.

C: 0.55-1.10%

C is an element which improves hardness, wear resistance, and fatigue life after quenching and tempering. If the C content is less than 0.55%, it will be difficult to obtain sufficient hardness. Desirably, the C content needs to be 0.60% or more. On the other hand, if the C content is more than 1.10%, the hardness of the steel material will increase, impairing the workability such as machinability and forgeability. In addition, the amount of carbides in the structure will increase more than necessary, and the alloy concentration in the matrix will decrease, leading to reduction in hardness and hardenability of the matrix. It is thus necessary to make the C content not more than 1.10%, and desirably not more than 1.05%. Accordingly, the C content is set to 0.55-1.10%, and desirably to 0.60-1.05%.

Si: 0.10-2.00%

Si is an element which is effective in deoxidation of the steel, and serves to impart required hardenability to the steel and enhance its strength. Si is dissolved in cementite in a solid state to increase the hardness of the cementite, thereby improving wear resistance. To achieve these effects, the Si content needs to be 0.10% or more, or desirably 0.20% or more. On the other hand, if Si is contained in a large amount, it will increase the hardness of the material, impairing the workability such as machinability and forgeability. It is thus necessary to make the Si content not more than 2.00%, and desirably not more than 1.55%. Accordingly, the Si content is set to 0.10-2.00%, and desirably to 0.20-1.55%.

Mn: 0.10-2.00%

Mn is an element which is effective in deoxidation of the steel and necessary for imparting required hardenability to the steel and enhancing its strength. To this end, the Mn content needs to be 0.10% or more, or desirably 0.15% or more. On the other hand, if Mn is contained in a large amount, it will decrease the toughness. It is thus necessary to make the Mn content not more than 2.00%, and desirably not more than 1.00%. Accordingly, the Mn content is set to 0.10-2.00%, and desirably to 0.15-1.00%.

P: 0.030% or less

P is an impurity element which is contained unavoidably in the steel. P segregates in the grain boundary and deteriorates the toughness. Accordingly, the P content is set to 0.030% or less, and desirably to 0.015% or less.

S: 0.030% or less

S is an impurity element which is contained unavoidably in the steel. S combines with Mn to form MnS, and deteriorates the toughness. Accordingly, the S content is set to 0.030% or less, and desirably to 0.010% or less.

Cr: 1.10-2.50%

Cr is an element which improves hardenability and also facilitates spheroidization of carbides by spheroidizing annealing. To obtain such effects, the Cr content needs to be 1.10% or more, or desirably 1.20% or more. On the other hand, if Cr is added in an excessively large amount, cementite will become brittle, leading to deterioration in toughness. It is thus necessary to make the Cr content not more than 2.50%, and desirably not more than 2.15%. Accordingly, the Cr content is set to 1.10-2.50%, and desirably to 1.20-2.10%.

Al: 0.010-0.10%

Al is an element effective in deoxidation of the steel. Further, Al is an element effective in suppressing grain coarsening, as it combines with N to generate AlN. For achieving the effect of suppressing grain coarsening, the Al content needs to be 0.010% or more. On the other hand, if Al is added in a large amount, it will generate nonmetallic inclusions, which will become origins of cracking. Accordingly, the Al content is set to 0.10% or less, and desirably to 0.050% or less.

Ni, Mo, and V are elements from which any one or two or more elements are contained selectively. They are contained under this condition and limited for the following reasons.

Ni: 0.10-1.50%

Ni is an element which is contained under the above-described condition of being contained selectively. Although Ni needs to be contained in an amount of 0.10% or more for dissolution and it is an element effective in improving the hardenability and toughness, Ni is an expensive element, increasing the cost. Accordingly, the Ni content is set to 0.10-1.50%, and desirably to 0.15-1.00%.

Mo: 0.05-2.50%

Mo is an element which is contained under the above-described condition of being contained selectively. Although Mo needs to be contained in an amount of 0.05% or more for dissolution and it is an element effective in improving the hardenability and toughness, Mo is an expensive element, increasing the cost. Accordingly, the Mo content is set to 0.05-2.50%, and desirably to 0.05-2.00%.

V: 0.01-0.50%

V is an element which is contained under the above-described condition of being contained selectively. V needs to be contained in an amount of 0.01% or more for dissolution. Further, V forms carbides, and it is an element effective in refining the grains. However, if V is contained in an amount of more than 0.50%, the effect of refining the grains will become saturated, and the cost will increase. Further, V is an element which may form carbonitrides in a large amount, deteriorating processing property. Accordingly, the V content is set to 0.01-0.50%, and desirably to 0.01-0.35%.

That the spheroidized cementite particles with an aspect ratio of 1.5 or less constitute at least 90% of all cementite particles.

An aspect ratio defining the ratio of major axis to minor axis of spheroidized carbide provides an indication of spheroidization. Cementite particles having a large aspect ratio, such as those having plate-like shape or nearly columnar shape, would likely become origins of cracking as stress would focus on the ends of such cementite particles during deformation. In contrast, cementite particles of nearly spherical shape would have no portion on which stress concentrates, so they have a lower risk of causing cracking. FIG. 1 is a schematic diagram showing that a cementite particle having a large aspect ratio becomes an origin of cracking. Thus, as compared to a structure in which a large number of cementite particles having a large aspect ratio are distributed, a structure in which a large number of cementite particles having an aspect ratio close to 1, i.e. cementite particles of nearly spherical shape, are distributed has a lower risk of causing cracking from the cementite particles when a load is applied, and has improved toughness. When a cementite particle has an aspect ratio of 1.5 or less, its harmful effect of becoming an origin of cracking can be lowered, and it is more preferable that the proportion of the number of such cementite particles to the total number of cementite particles takes a larger value. Accordingly, it is configured such that the spheroidized cementite particles with an aspect ratio of 1.5 or less constitute at least 90%, and preferably at least 95% (including 100%), of all the cementite particles. It should be noted that the deformation load shown by arrows in FIG. 1 is not limited to compression.

That the proportion of the number of spheroidized cementite particles on the prior austenite grain boundaries to a total number of cementite particles is 20% or less.

The steel as recited in claim 1 of the present application falls within the range of hypereutectoid steel in view of the content of C in the chemical components. In a hypereutectoid steel, the mode of brittle fracture deteriorating the shock resistance property is primarily intergranular fracture along the prior austenite grain boundaries. This is caused by cementite on the prior austenite grain boundaries (particularly, reticular carbides along the grain boundaries). Cementite that precipitates and exists at the grain boundaries is easier to become an origin of fracture and more harmful as compared to cementite in the grains. Thus, it is not preferable that such cementite exists at the grain boundaries. Accordingly, it is configured such that the proportion of the number of spheroidized cementite particles on the prior austenite grain boundaries to the total number of cementite particles is 20% or less, desirably 10% or less, and further desirably 5% or less (including 0%).

That at least 90% of the spheroidized cementite particles on the prior austenite grain boundaries have a particle size of 1 μm or less.

As explained in the above paragraph, it is not preferable that cementite particles exist on the prior austenite grain boundaries. Particularly, reticular carbides or similarly coarse carbides along the grain boundaries have increased risks of becoming origins of intergranular fracture. Therefore, it is configured such that at least 90%, and preferably at least 95% (including 100%), of the spheroidized cementite particles have a particle size of 1 μm or less, which is low in harmfulness.

It should be noted that % here is the proportion when the total number of carbides observable by a scanning electron microscope with a magnification of about 5000 times is set to be 100%. Very fine carbides which cannot be observed with that magnification power are not taken into account, as they will hardly influence the toughness.

That the prior austenite grains have a grain size of 1-5 μm.

Refining prior austenite grains can reduce the unit of fracture of intergranular fracture or cleavage fracture, and can increase the energy required for fracture, leading to improved toughness. Further, finer prior austenite grains can reduce segregation of impurity elements such as P and S, which would segregate at the grain boundaries and deteriorate toughness. As such, refining the grains is a very effective way of enhancing the toughness without decreasing the hardness. The reasons for setting the grain size of the prior austenite grains to 1-5 μm are as follows. Producing products having prior austenite grains with a grain size of less than 1 μm in an industrially stable manner is difficult and increases the cost, so the lower limit of the grain size of the prior austenite grains is set to 1 μm. When the upper limit of the grain size of the prior austenite grains is set to 5 μm, the above effects become noticeable, making it possible to obtain a steel material having balanced hardness and toughness. Accordingly, it is configured such that the prior austenite grains have a grain size of 1-5 μm.

An embodiment of the present invention will be described below with reference to Examples and Tables.

Examples

Figure 2:
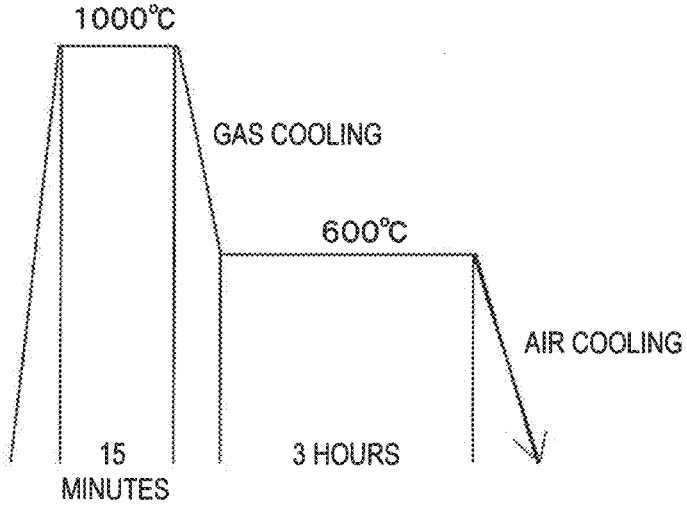
FIG. 2 shows a pattern of pearlitization processing.
Figure 3:
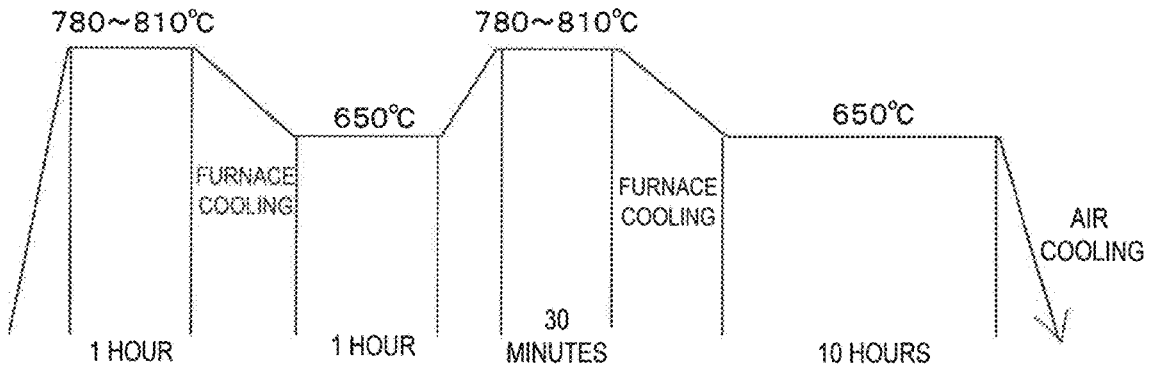
FIG. 3 shows a pattern of spheroidizing annealing.
Figure 4:
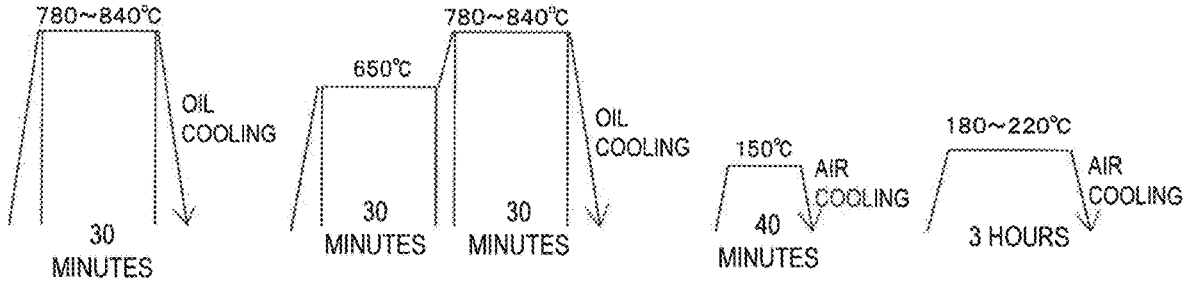
FIG. 4 shows a pattern of quenching and tempering.
Figure 5:
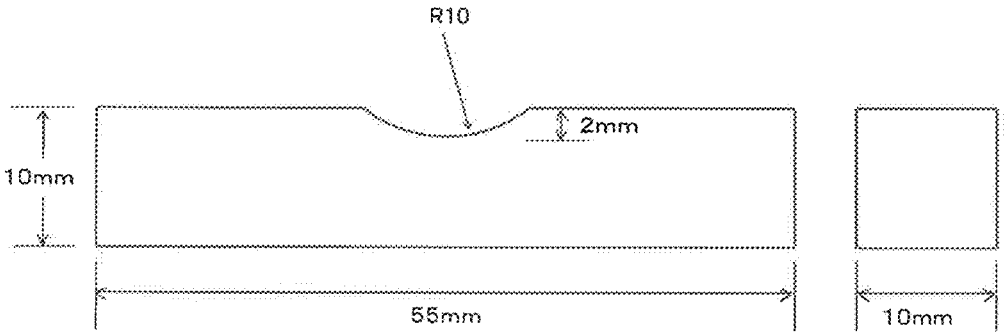
FIG. 5 shows a shape of 10-RC notched Charpy impact test specimen.

Steels having the chemical compositions of Inventive Examples Nos. 1 to 7 and Comparative Examples Nos. 8 to 11 shown in Table 1 below were produced in a 100-kg vacuum melting furnace. The obtained steels were each subjected to hot forging at 1150° C. to obtain a round bar having a diameter of 26 mm, which was then cut into 250 mm in length to form a test sample. Next, heat treatment was carried out, as pearlitization processing as shown in FIG. 2, in which each round bar steel was held at 1000° C. for 15 minutes and then gas-cooled to 600° C. It was held at 600° C. for three hours and then air-cooled. Thereafter, spheroidizing annealing was carried out, as shown in FIG. 3, in which heat treatment of furnace-cooling the bar steel from 780° C. to 650° C. was repeated twice. The resultant bar steels were then each shaped roughly into a 10-RC notched Charpy impact test specimen, which was then subjected to processing as shown in FIG. 4. Specifically, each test specimen was held at a temperature range of 780-840° C. for 30 minutes for oil quenching, which was performed at least twice. Then, for preventing season cracking, it was subjected to temporary tempering processing in which it was held at 150° C. for 40 minutes before being air-cooled. It was then subjected to tempering processing in which it was held at a temperature range of 180-220° C. for 90 minutes before being air-cooled. Further, the resultant rough-shaped specimens were subjected to finishing work, whereby the 10-RC notched Charpy impact test specimens as shown in FIG. 5 were obtained.

In Table 1, "*" added to 0.06-0.08% Ni, "*" added to 0.04% Mo, and the hyphens for V mean that they are unavoidable impurities. Therefore, the steels of Inventive Examples No. 1 and No. 2 correspond to the steel recited in claim 1, and the steels of Inventive Examples Nos. 3 to 7 correspond to the steel recited in claim 2.

TABLE 1

(Unit: mass %)

| | No. | C | Si | Mn | P | S | Ni | Cr | Mo | Al | V |
|---|---|---|---|---|---|---|---|---|---|---|---|
| Steel of | 1 | 1.00 | 0.26 | 0.40 | 0.015 | 0.005 | 0.08* | 1.35 | 0.04* | 0.018 | — |
| Inventive | 2 | 0.89 | 0.27 | 2.00 | 0.013 | 0.006 | 0.08* | 1.99 | 0.04* | 0.023 | — |
| Example | 3 | 0.92 | 0.26 | 0.20 | 0.012 | 0.005 | 0.07* | 2.03 | 0.15 | 0.020 | — |
| | 4 | 0.91 | 0.26 | 0.21 | 0.012 | 0.005 | 0.07* | 1.34 | 1.99 | 0.030 | 0.15 |
| | 5 | 0.90 | 1.50 | 1.00 | 0.011 | 0.005 | 0.07* | 1.34 | 0.04* | 0.014 | 0.14 |
| | 6 | 0.90 | 1.53 | 0.41 | 0.012 | 0.005 | 0.06* | 1.35 | 0.50 | 0.017 | 0.15 |
| | 7 | 0.97 | 0.25 | 0.99 | 0.014 | 0.006 | 0.99 | 1.35 | 0.30 | 0.018 | — |
| Steel of | 8 | 0.99 | 0.25 | 2.03 | 0.013 | 0.005 | 0.08* | 1.36 | 0.04* | 0.016 | — |
| Comparative | 9 | 1.00 | 0.25 | 0.40 | 0.014 | 0.005 | 1.99 | 1.34 | 0.04* | 0.016 | — |
| Example | 10 | 1.01 | 0.25 | 0.99 | 0.015 | 0.006 | 1.99 | 1.36 | 0.30 | 0.500 | — |
| | 11 | 1.00 | 1.01 | 0.42 | 0.012 | 0.005 | 1.00 | 1.36 | 0.15 | 0.525 | 0.15 |

1) The underlined values are outside the scope of the present invention.

2) "*" means that they are unavoidable impurities.

These 10-RC notched Charpy impact test specimens were subjected to a Charpy impact test at room temperature. Further, these test specimens were subjected to hardness measurement, and also to scanning electron microscopy to obtain the size of prior austenite grains.

Table 2 below shows the prior austenite grain size (μm), the HRC hardness, and the Charpy impact value (J/cm$^2$) as the results of the above-described Charpy impact test, hardness measurement, and scanning electron microscopy. Table 2 also shows, as the features of the structure after quenching, the proportion of the number of spheroidized cementite particles having an aspect ratio of 1.5 or less, the proportion of the number of spheroidized cementite particles on the prior austenite grain boundaries, and the particle size of the spheroidized cementite particles on the prior austenite grain boundaries.

TABLE 2

| | No. | Proportion of cementite particles with aspect ratio of 1.5 or less to the total number of cementite particles (%) | Proportion of the number of cementite particles on prior austenite grain boundaries to the total number of cementite particles (%) | Proportion of cementite particles with particle size of 1 μm or less among the cementite particles on prior austenite grain boundaries | Prior austenite grain size (μm) | HRC hardness | Charpy impact value (J/cm$^2$) |
|---|---|---|---|---|---|---|---|
| Steel of Inventive Example | 1 | 92 | 18 | 96 | 5 | 61 | 55 |
| | 2 | 97 | 10 | 98 | 4 | 60 | 52 |
| | 3 | 95 | 16 | 94 | 3 | 58 | 78 |
| | 4 | 97 | 10 | 95 | 2 | 59 | 51 |
| | 5 | 98 | 8 | 96 | 2 | 60 | 60 |
| | 6 | 95 | 14 | 92 | 1 | 61 | 56 |
| | 7 | 95 | 9 | 92 | 4 | 62 | 45 |
| Steel of Comparative Example | 8 | 85 | 18 | 85 | 6 | 61 | 29 |
| | 9 | 93 | 27 | 93 | 6 | 60 | 37 |
| | 10 | 83 | 16 | 91 | 4 | 60 | 28 |
| | 11 | 91 | 23 | 84 | 3 | 61 | 33 |

1) The underlined values for the steels of Comparative Examples are outside the scope of the present invention.

Figure 6:
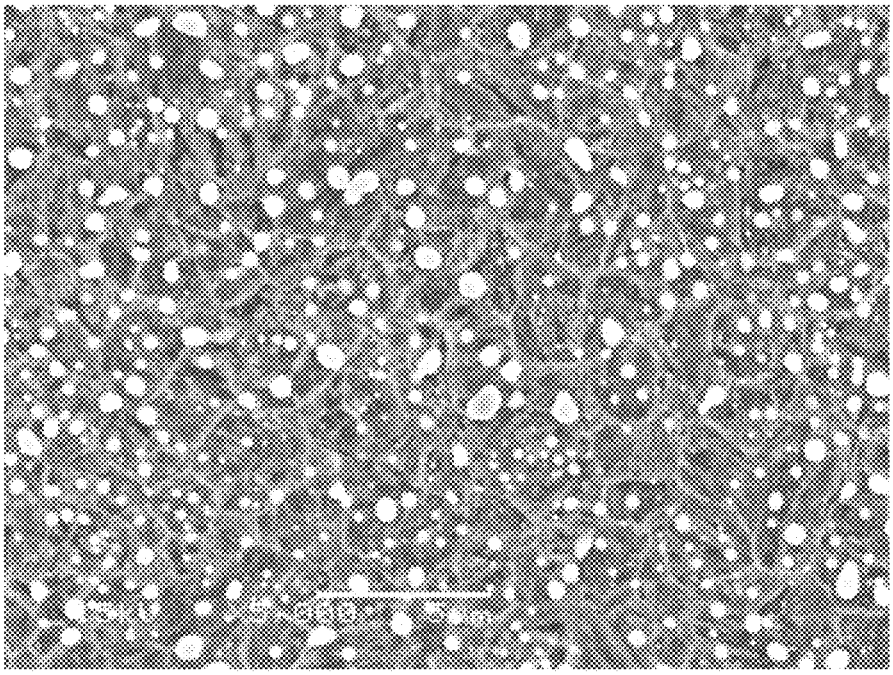
FIG. 6 is a photograph, taken by a scanning electron microscope (SEM), showing the structure of a steel of Inventive Example No. 3 after quenching, which is a secondary electron image of 5000-fold magnification obtained using an accelerating voltage of 15 kV, the scale bar shown in the lower portion corresponding to 5 μm.

In Table 2, the underlined values for the steels of Comparative Examples Nos. 8 to 11 are outside the claimed invention. These steels of Comparative Examples falling outside the claimed invention each had a Charpy impact value of less than 40 J/cm$^2$, and it was not possible to obtain enough hardness and toughness at the same time with these steels. In contrast, the steels of Inventive Examples fulfilling all the requirements of the claims each have a hardness of 58 HRC or more and a Charpy impact value of 40 J/cm$^2$ or more, showing that they support both enough hardness and enough toughness. FIG. 6 shows, as an exemplary structure, the structure of the steel of Inventive Example No. 3 after quenching. It is a dual phase structure of martensitic structure and cementite. Regarding the cementite in the structure, the amount of cementite particles having an aspect ratio of 1.5 or more is small, and the amount of cementite particles on the prior austenite grain boundaries is small. Of the cementite particles on the prior austenite grain boundaries, the amount of cementite particles having a size of greater than 1 μm is small, and the prior austenite grains have a grain size of 3 μm. It is thus recognized that the structure obtained falls within the scope of the claimed invention.

It should be understood that the embodiment and the inventive examples disclosed herein are illustrative and non-restrictive in every respect. The scope of the present invention is defined by the terms of the claims, rather than the description above, and is intended to include any modifications within the scope and meaning equivalent to the terms of the claims.

The invention claimed is:

1. A steel comprising, in mass %, 0.55-0.92% C, 0.10-2.00% Si, 0.10-2.00% Mn, 0.030% or less P, 0.030% or less S, 1.10-2.50% Cr, and 0.010-0.10% Al, with the balance consisting of Fe and unavoidable impurities; a structure of the steel after quenching being a dual phase structure of martensitic structure and spheroidized carbide; spheroidized cementite particles with an aspect ratio of 1.5 or less constituting at least 90% of all cementite particles; regarding cementite on prior austenite grain boundaries, a proportion of the number of spheroidized cementite particles on the prior austenite grain boundaries to a total number of cementite particles being 20% or less, wherein at least 90% of the spheroidized cementite particles on the prior austenite grain boundaries have a particle size of 1 μm or less.

2. The steel according to claim 1, further comprising, in mass %, one or two or more selected from among 0.10-1.50% Ni, 0.05-2.50% Mo, and 0.01-0.50% V.

3. The steel according to claim 1, wherein prior austenite grains have a grain size of 1-5 μm.

4. The steel according to claim 2, wherein prior austenite grains have a grain size of 1-5 μm.

5. The steel according to claim 1, wherein the steel has a HRC hardness of 58 HRC or more.

6. The steel according to claim 1, further comprising, in mass %, 0.01-0.50% V.

7. The steel according to claim 1, further comprising, in mass %, 0.01-0.08% Ni.

8. The steel according to claim 1, further comprising, in mass %, 0.30-2.50% Mo.

9. The steel according to claim 1, wherein prior austenite grains have a grain size of 1-2 μm.

10. The steel according to claim 1, wherein the proportion of the number of spheroidized cementite particles on the prior austenite grain boundaries to the total number of cementite particles being 20% or less and 8% or more.

11. The steel according to claim 1, wherein the steel has a Charpy impact value of 51 J/cm$^2$ or more.

* * * * *